United States Patent [19]

Johnson

[11] Patent Number: 4,832,562

[45] Date of Patent: May 23, 1989

[54] INTEGRATED AIR BEARING SLIP SHEET MATERIAL HANDLING SYSTEM AND SLIP SHEET EMPLOYED THEREIN

[76] Inventor: Raynor A. Johnson, 904 Old Baltimore Pike, Newark, Del. 19711

[21] Appl. No.: 730,019

[22] Filed: May 3, 1985

[51] Int. Cl.[4] ..... B66F 9/12

[52] U.S. Cl. ..... 414/661; 180/125; 414/676

[58] Field of Search ..... 414/661, 676, 280, 497, 414/607, 608; 180/125

[56] References Cited

U.S. PATENT DOCUMENTS

| | | | |
|---|---|---|---|
| 2,619,241 | 11/1952 | Jessen | 414/661 |
| 3,834,556 | 9/1974 | Crimmins | 414/676 |
| 3,948,344 | 4/1976 | Johnson et al. | 414/676 X |
| 4,155,421 | 5/1979 | Johnson et al. | 414/676 X |
| 4,298,083 | 11/1981 | Johnson et al. | 414/676 X |
| 4,417,638 | 11/1983 | Harvey | 180/125 |
| 4,528,704 | 7/1985 | Wegener et al. | 414/676 X |

*Primary Examiner*—David A. Bucci

*Attorney, Agent, or Firm*—Sughrue, Mion, Zinn, Macpeak & Seas

[57] ABSTRACT

An air bearing slip sheet tight material handling system utilizes a forklift truck with a horizontal platen a pantagraph mechanism supporting a vertical faceplate which has a gripper jaw pocket casing at the bottom. A vertically reciprocating clamping bar is depressable within the gripper jaw pocket casing to clamp the lip of a slip sheet. The slip sheet is of the air bearing type formed of thin flexible sheets sealed together about the edges to define a plenum chamber and forming a load support portion over a major surface outside of the lip area. A plurality of pinhole perforations are provided within the central portion of the bottom thin flexible sheet conforming to the footprint of the load carried by the slip sheet. An air source supplies pressurized air which is directed from a hose air outlet aligned with the air inlet of the slip sheet lip during depression of the clamping bar such that compressed air is directed into the chamber interior of the slip sheet lip for flow about the clamping area and from the air chamber of the lip to the plenum chamber for jacking of the load and creation of the air bearing.

14 Claims, 4 Drawing Sheets

10
12
13
14
16
18
22
24
26
28
28a
30
31
32
34
36
38
40
42
43
44
45
46
47
48
50
51
52
53
54
55
56
57
58
59
60
61
62
64
64a
65
78
80
96
L

FIG. 1a
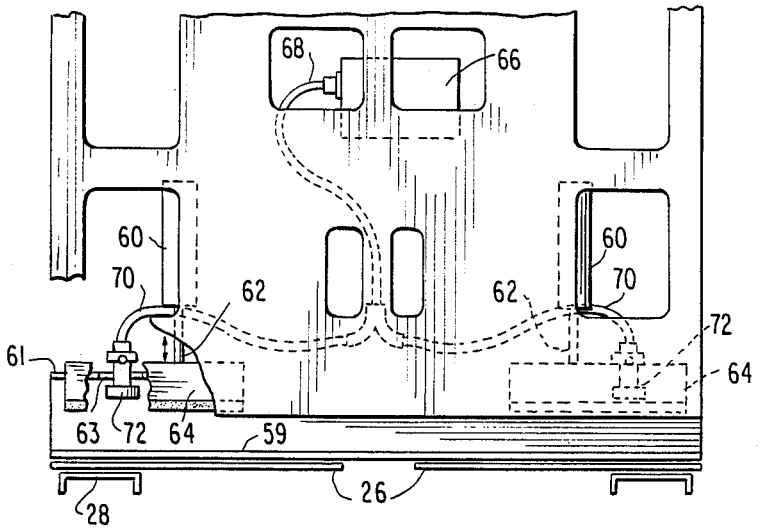
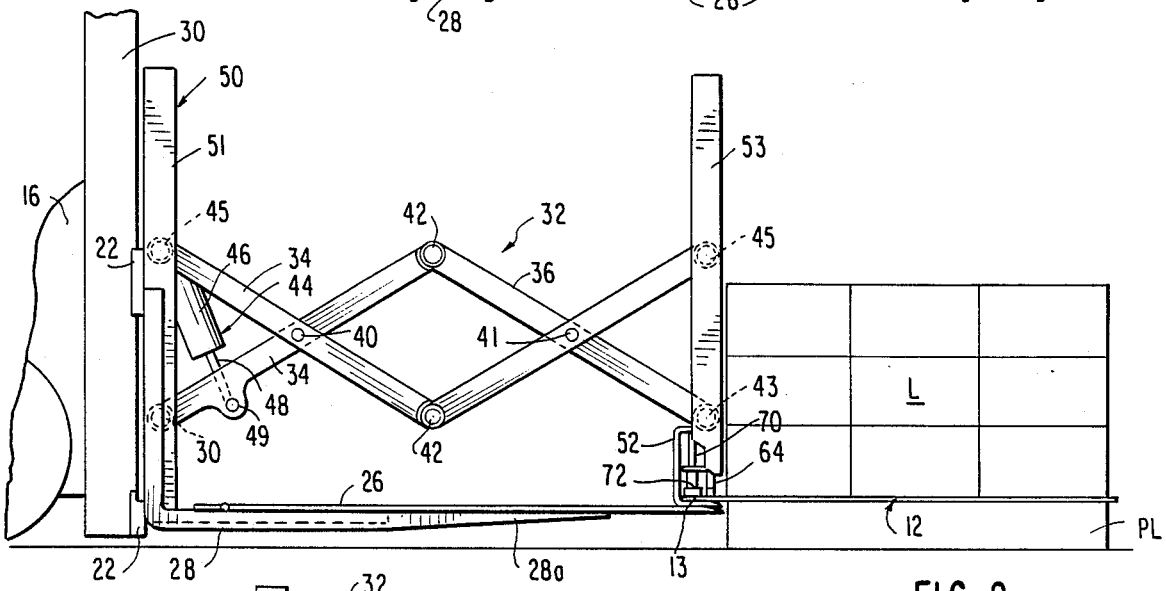
FIG. 2
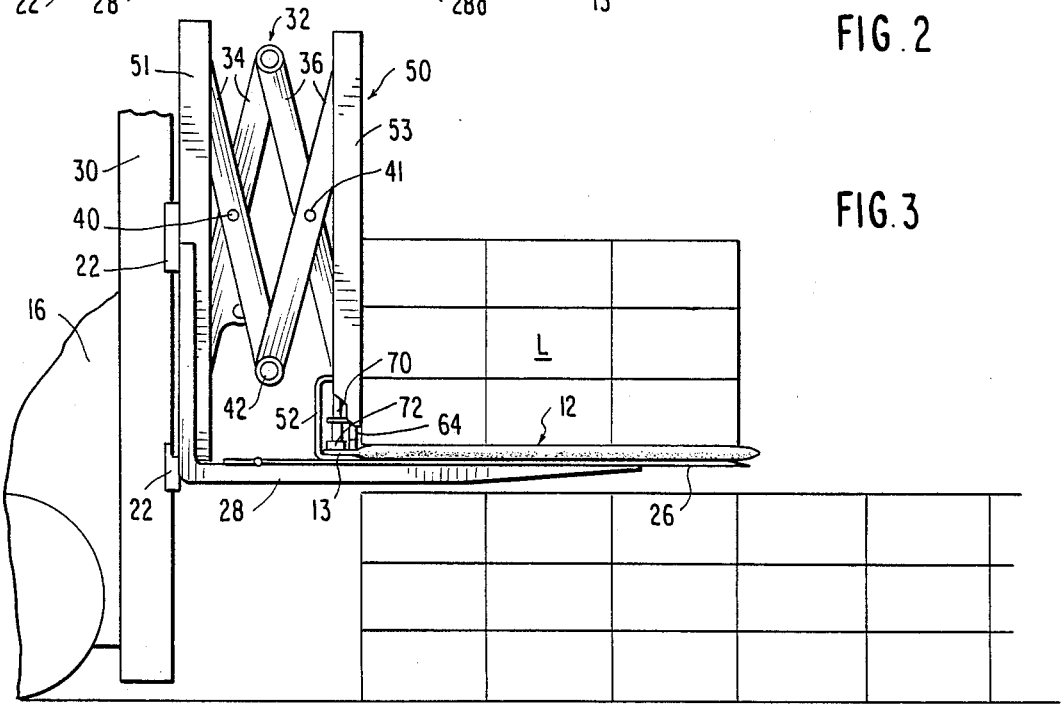
FIG. 3

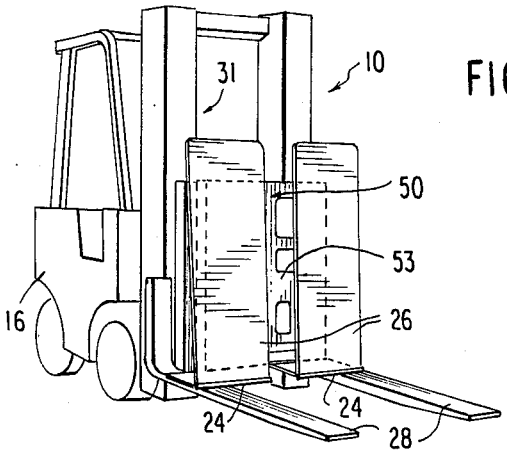
FIG. 6
FIG. 7a
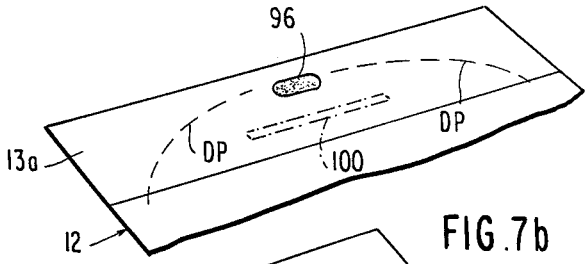
FIG. 7b
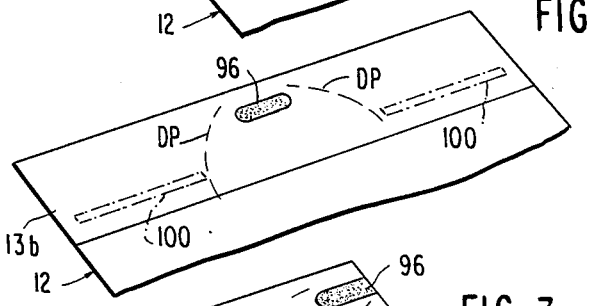
FIG. 7c
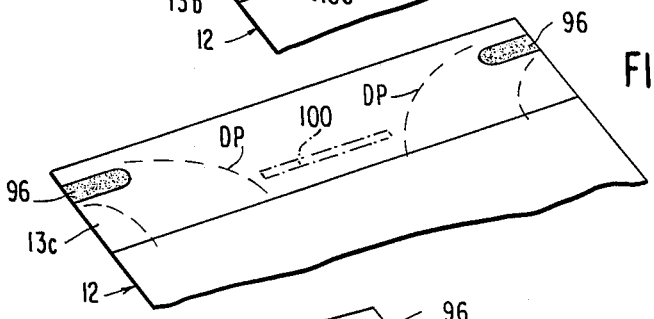
FIG. 7d
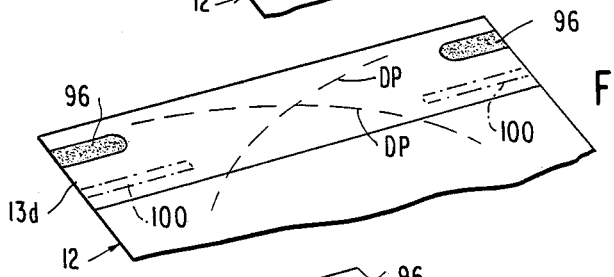
FIG. 7e
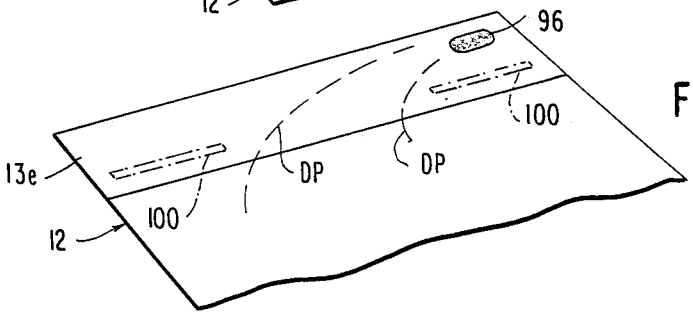

INTEGRATED AIR BEARING SLIP SHEET MATERIAL HANDLING SYSTEM AND SLIP SHEET EMPLOYED THEREIN

FIELD OF THE INVENTION

This invention relates to material handling systems using slip sheets, and more particularly to an improved slip sheet incorporating a low pressure, low CFM air bearing and a forklift type material handling system employing such air bearing slip sheet.

BACKGROUND OF THE INVENTION

Conventionally, unitized case loads, such as multiple cartons of finished case goods stacked on top of each other and in side-by-side rows, and forming generally rectangular unitized loads of several thousand pounds, are conventionally borne by either wood pallets upon which the unitized case goods are stacked or slip sheets sized to the load, underlying the same and incorporating lips which project from beneath the case goods to one side thereof for facilitating case load transport.

Wooden pallets have been an important tool in handling of unitized case loads in the past century. Finished cased goods, such as canned foods and the like, are normally inventoried on wood pallets prior to their distribution. A typical wood pallet costs approximately $7.00, and while useful, they require replacement periodically. Further, such wood pallets are relatively heavy, weighing fifty pounds or so, and take considerable space.

Further, material handling systems involve the use of forklift trucks or the like having a pair of forks which readily project underneath and into these wood pallets to permit lifting of the wooden pallet and finished case goods for transport thereof. The more modern forklift trucks include vertical elevator systems as well as lateral extension and retraction of the forks borne by the elevator mechanism to facilitate loading, unloading, and stacking of the pallet borne loads.

As may be appreciated, not only do the wood pallets take up space when warehousing the case goods, but during transport, as for instance within tractor trailers, railroad boxcars or the like, the mass of the wooden pallets reduce the case goods content of the shipment while materially contributing to the overall weight of the shipment. Pallets significantly reduce the payload, thus increasing the per unit freight costs for the case goods.

In an attempt to substantially reduce the cost of material handling systems, thin rectangular slip sheets made of cardboard, solid fiber or the like, have been employed in material handling systems for handling the same unitized case goods loads that wood pallets handle. Slip sheets typically cost about one-tenth that of wood pallets. The average slip sheet weighs less than five pounds, compared to the fifty pounds for wooden pallets. The life of the slip sheets, however, is significantly less than that of the wooden pallets. Further, the slip sheets comprise nothing more than a rectangular piece of thin sheet material normally having a lip integral with the sheet along one edge or more, which projects outwardly of he load. The load covers the rectangular central portion of the slip sheet, while the projecting lip facilitates push-pull movement of the slip sheet and case goods. In that respect, to reduce labor hours in handling of the finished case goods, a forklift with a push-pull attachment is employed. The push-pull attachment is constituted by two components. One or more vertically reciprocating clamps are mounted above and are projectable down to and against the forks of the forklift truck, or an underlying rigid, inclined support surface. Typically, the vertical clamping mechanism is carried by a vertical wall known as load alignment member or face plate which is moved into contact with the front wall of the unitized case load, which load alignment member is projectable away from a narrow vertical pantagraph frame at the forklift truck body or chassis and outwardly beyond the underlying forks at the base of the chassis. Once the lip is clamped, the lip, flap, or tab acts as the fulcrum for the slip sheet, permitting the slip sheet to be pulled back onto and up the slope of the inclined forks until the slip sheet is fully supported by the forks (or their equivalent). If the forklift truck has its push-pull mechanism supported by an elevator, the elevator permits the forks, the push-pull unit and the load to be lifted vertically for multiple stacking of the unitized loads, one upon each other, separated by the slip sheet which is left under the newly stacked load and between the bottom of that unitized case load and the top of the immediately underlying unitized case load.

While such conventional slip sheet type material handling systems have substantially reduced the cost over material handling system utilizing wood pallets, they require forklift trucks capable of handling the full weight of the loads imposed on the slip sheets during push-pull operation. This, in turn, requires the slip sheets to be of relatively high strength, since intense tractive stresses exist in the slip sheets when the slip sheets are pulled across the underlying support surface with the case loads thereon. Further, large size, high load capacity motors are required to push, pull and lift the loads borne by the slip sheets.

In recent years, the applicant in conjunction with William D. Fletcher developed a low cost planar air pallet material handling system, as exemplified by U.S. Pat. No. 3,948,344 issuing Apr. 6, 1976. The system therein includes use of a modified forklift truck or like vehicle having projecting forwardly of the vehicle a pair of forks extending horizontally from a vertical plate, to the rear of which, is provided an open rectangular vertical frame functioning as a backing for the load supported on the forks. The load, in this case, is supported on an air pallet. In U.S. Pat. No. 3,948,344, the forklift forks penetrate plenum chambers, interior of the flexible thin sheet air pallet. The forks carry passages for delivering air under low pressure and at low CFM to selective plenum chambers defined by multiple flexible thin sheets bearing perforations in the load area and sandwiching an intermediate imperforate sheet having internal air dispersion means. The forks which penetrate air inlets for respective plenum chambers defined by a perforated sheet and the central imperforate sheet, produce selectively, as a result of air passage therethrough, an air bearing between the load and the air pallet or between the air pallet and the underlying support surface. As may be appreciated, by creating an air bearing between the air pallet and an underlying support surface, very little energy is required to slide the load off the underlying support surface due to the frictionless support of the same.

In other embodiments of the invention of U.S. Pat. No. 3,948,344, mechanical clamps are employed for clamping about an air pallet carrying a unitized case load constituted by as series of boxes or cartons stacked in side-by-side fashion. An edge of the air pallet extends outwardly from beneath the load and permits an air clamp to be coupled thereto. Pressurized air delivered through tubing via the air clamp and a passage therethrough permits flow of air under low pressure into the plenum chamber and thence out of the multiple perforations to form a low pressure, low CFR air bearing beneath the air pallet and between the air pallet and the underlying planar support surface. A very light, manual pulling or pushing force exerted by the operator carries the air pallet and its load to move effortlessly on a frictionless air bearing.

While the content of the low cost planar air pallet material handling system of U.S. Pat. No. 3,948,344 provides perhaps a third and seperate alternative to use of wood pallet type material handling systems and slip sheet material handling systēms, no attempts have been made to integrate such air pallet concepts to the conventional slip sheet material handling sytems and to utilize the best features of each.

It is, therefore, a primary object of the present invention to provide an improved integrated air bearing slip sheet material handling system as a replacement for wood pallet or standard slip sheet type material handling system, and wherein the air bearing slip sheet permits forklift trucks and the like to operate with significantly size and mass reduced push-pull mechanisms, hydraulic, pneumatically or mechanically operated, along with the clamping mechanisms for clamping the slip sheet lip to the push-pull mechanism itself, materially reducing the overall cost of the forklift truck or the like.

It is a further object of the present invention to provide an improved air bearing slip sheet for use in such a material handling system in which the slip sheet is of simplified construction and in which air distribution throughout the plenum chamber of the air bearing slip sheet is assured, irrespective of the presence of the mechanical clamp necessary to facilitate push-pull movement of the slip sheet and load after air pressurization and creation of the air bearing between the slip sheet and the underlying relatively fixed support surface.

SUMMARY OF THE INVENTION

The present invention is directed to an improved air bearing slip sheet, and to an air bearing slip sheet type material handling system including the same and, particularly, directed to a forklift truck for facilitating material handling by use of the air bearing slip sheet. In the material handling system, a forklift or other wheeled vehicle having a vehicle chassis includes platen means extending generally horizontally from the vehicle chassis at the bottom thereof in a forward direction and terminating in a forward edge for contacting an underlying support surface bearing the wheeled vehicle. A push-pull mechanism is mounted to the vehicle chassis and includes a vertical narrow frame. A pantagraph mechanism mounted to the narrow vertical frame at one end, further mounts at its opposite end a vertical face plate. The face plate has a gripper jaw pocket casing at the bottom thereof defining a horizontal slot running the width of the narrow frame for overlying the tip of the platen means. The system further comprises an air bearing slip sheet comprised of top and bottom thin flexible sheets sealed together about the edges thereof to define a plenum chamber therebetween and forming a load support portion over a major surface area thereof. At least one integral lip is provided along an edge of the air bearing slip sheet projecting outside of the load area. One of the slip sheet and the load comprises a generally planar rigid backing member within the load area. A plurality of pinhole perforations are provided within a central portion of the bottom thin flexible sheet over an area conforming to the footprint of the load carried by the slip sheet on the generally planar rigid backing member. The lip is positionable within the gripper jaw pocket when projecting laterally exterior of the load. Air inlet means are provided within the top thin flexible sheet at the lip. At least one clamping bar is mounted to the face plate above the gripper jaw pocket casing for clamping the lip against the bottom of the gripper jaw casing such that retraction of the pantagraph mechanism with the lip clamped to the bottom of the gripper jaw pocket casing causes the slip sheet and the load to move onto the platen while extension of the pantagraph mechanism from its retracted position pushes the slip sheet and the load off the platen and away from the chassis. A lower pressure air source may be carried by one of the load and the vehicle and an air supply hose coupled to the air source terminates in an air outlet. Means are provided for projecting and retracting the clamping bar into and out of the gripper jaw pocket casing and for operatively connecting the hose air outlet to the air inlet means of the slip sheet lip for alignment with an air inlet opening of the slip sheet lip. Thus, automatically upon operation of the air unit and depression of the clamping bar, compressed air is directed into the air chamber interior of the slip sheet lip for flow about the clamping area and from the air chamber of the lip to the plenum chamber for jacking of the load and creation of an air bearing, such that the presence of the air bearing beneath the slip sheet underlying the load permits relatively frictionless movement of the slip sheet and the load carried thereby onto and from the platen of the forklift truck. Preferably, the end of the hose forming the air outlet is mechanically coupled to the clamping bar and movable therewith for automatic connection of the air supply hose to the slip sheet air inlet opening of the lip to permit pressurization of the lip chamber and the plenum chamber of the air bearing slip sheet upon clamping of the slip sheet adjacent to the hole by the clamping bar. The air bearing slip sheet preferably has the bottom thin flexible sheet including an area along the end thereof opposite that forming the lip which is devoid of perforations, and the air bearing slip sheet is further provide with air dispersion means for insuring rapid flow of low pressure air from the lip chamber to that area of the plenum chamber wherein the bottom thin flexible sheet is devoid of perforations at that end for causing pillowing of that end of the slip sheet to a similar degree to that of the slip sheet lip so as to balance the load during jacking of the load and the creation of the air bearing. Further, the air bearing slip sheet preferably includes a third thin flexible sheet overlying the top thin flexible sheet and being sealed about two sides thereof in the end remote from the lip with the third thin flexible sheet terminating at the lip in a free edge forming an opening to the pocket for slidable insertion and removal of the generally rigid planar backing member.

BRIEF DESCRIPTION OF THE DRAWINGS

FIG. 1*a* is a front elevational view, partially broken away, of the vertical face plate of the modified forklift truck of FIG. 1, utilizing two separate push-pull gripper jaws, separate hydraulic actuators, and illustrating in detail the low pressure, low CFM air supply to the air bearing slip sheet.

FIG. 2 is a side elevational view of the system as illustrated in FIG. 1 under conditions in which the slip sheet is clamped via multiple push-pull gripper jaws and an air bearing applied to the load supporting slip sheet prior to pulling the slip sheet and load onto the underlying rigid support surface borne by the forklift truck.

FIG. 3 is a further side elevational view with the load and air bearing slip sheet in raised position on the forklift truck for placement on top of the first tier of a multi-tier stacked load.

FIG. 6 is a perspective view of the forklift with the platform pivoted to vertical position against the push-pull face plate, thus permitting the forklift to be employed in conventional fashion in transporting loaded wooden pallets and the like.

FIGS. 7*a*–7*e* are perspective views of lip portions of a series of air bearing slip sheets showing various arrangements of clamping areas and air inlets, accordance with the present invention.

DESCRIPTION OF THE PREFERRED EMBODIMENT

Figure 1:
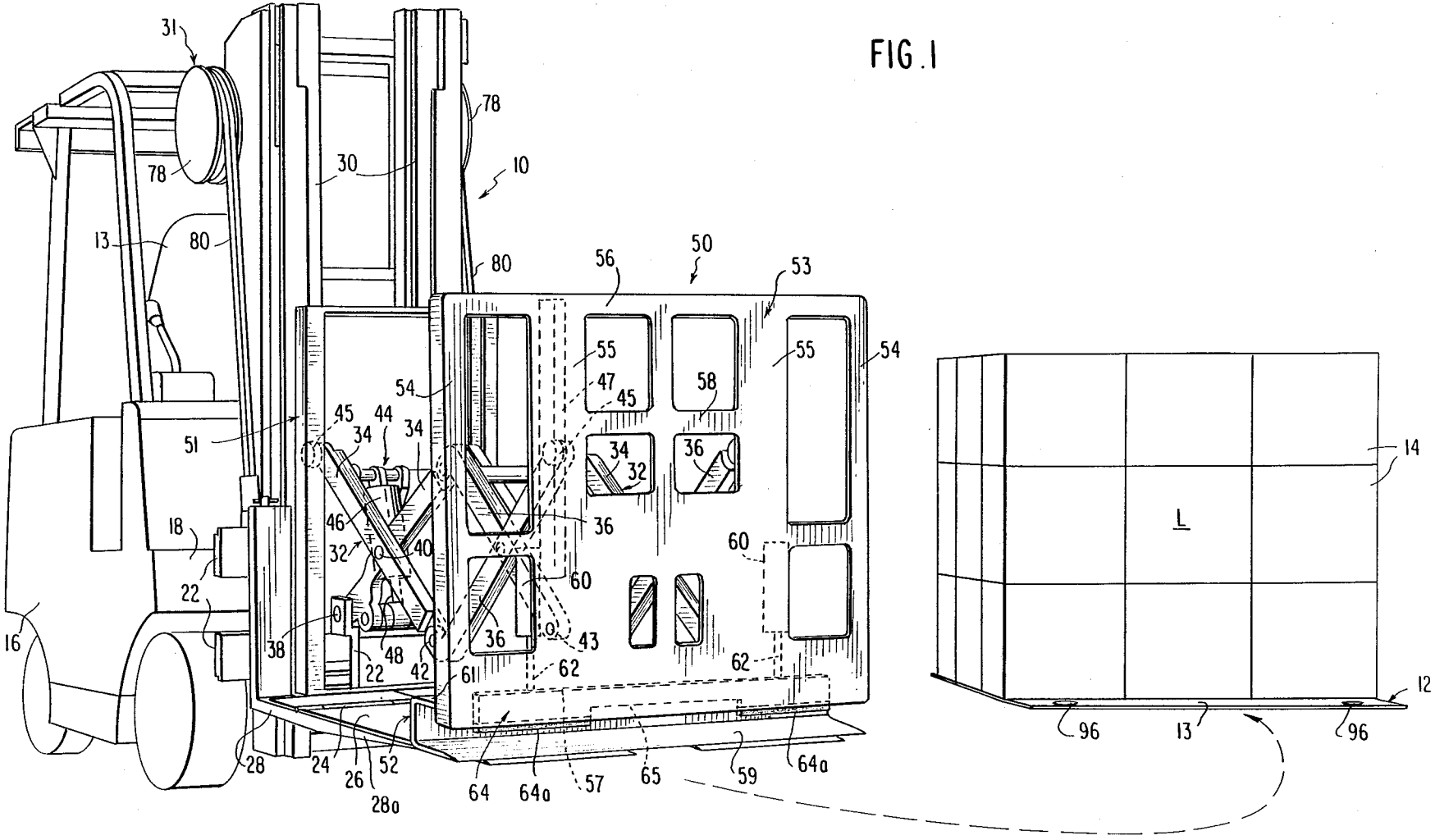
FIG. 1 is a perspective view of a modified forklift truck, and an air bearing slip sheet type bearing a unitary case load forming the principal components of an air bearing slip sheet type material handling system constituting one embodiment of the present invention.

Referring initially to FIG. 1, there is illustrated the two main components of the integrated air bearing slip sheet material handling system of the present invention. The firs is a modified forklift truck (or its equivalent) indicated generally at 10, and the second is the air bearing slip sheet indicated generally at 12. The slip sheet 12 underlies and supports a unitized case load designated at L and consisting of a plurality of rectangular, uniformly sized cardboard or paperboard cartons 14 containing internally cans of food or the like. It is noted that the cartons 14 are stacked in side-by-side fashion and, in turn, in end-to-end rows, three wide and three deep. The air bearing slip sheet 12 will be discussed in detail hereinafter. The initial description is to the modified forklift truck 10 capable of acting in conjunction with the air bearing slip sheet 12 for moving the slip sheet 12 and load L thereon and removing same therefrom by relatively modest, low energy components borne by the forklift truck 10.

Some aspects of the forklift truck 10 are quite conventional. The forklift truck 10 is provided with a chassis 16 having a seat 13 upon which an operator (not shown) rides. The operator steers the truck by means of a conventional steering means (not shown). The truck chassis 16 mounts on a horizontal rectangular frame 18 at its front end a pair of laterally spaced vertical beams 30. Cross plates 22, track mounted to beams 30, have conventional L-shaped forks 28 which are fixed to cross plates 22, whose tapered ends 28*a* project horizontally forwardly thereof. The forks 28 mount wedge-shaped platens 26 via pivot axle 24. Once the overlying platens 26 are rotated from their normal horizontal position to vertical position, the forklift truck 10 may be operated in conventional fashion to pick up and transport wooden pallets bearing suitable loads such as load L.

In addition, rearwardly of the platens 26, the forklift truck 10 forms with the laterally spaced vertical beams 30 the principal components of an elevator mechanism indicated generally at 31 capable of raising and lowering forks 28. Cross plates 22 which extends horizontally mount to and are vertically movable on the upright beams 30. In order to effect that movement, schematically, beams 30 carry at their upper ends drums as at 78 bearing cables 80, one end of each being fixed to the vertical upright cross plates 22 and the opposite end being trained about motor driven drums 78 capable of raising the total content of the load supported by forklift forks 28. Such components of the forklift truck 10 as described to this extent are conventional and are similar to those set forth in prior U.S. Pat. No. 3,948,344 of which I am copatentee.

Additionally, as conventionally found in some forklift trucks, forklift truck 10 incorporates a push-pull attachment mechanism, indicated generally at 50, supported for movement above forks 28 and indeed above the underlying pivotable rigid platens 26 which are key components of the modified forklift truck 10 of the present invention. In that respect, double pairs of retraction and extension arms 34, 36 form pantagraph assemblies 32 to each side of the forklift truck 10, one arm 34 being pivotably connected to a narrow open vertical frame 51 at fixed vertical support plate 22, as by hinges 38. The two arms 34 are hinged together by an intermediate hinge 40, the arms 36 are hinged together, intermediate their ends by pin 41, and the outboard end of each arm 34 is hinge connected as at 42 to a corresponding arm 36. One such arm 36 is hinge connected at 43 to vertical face plate 53. Rollers 45 are borne by the free ends of one arm 34 and one arm 36 which roll in guide grooves 47. One such arm 36 is hinge connected at 43. Face plate 53 terminates at its lower end in a C-shaped gripper arm pocket housing 52 opening forwardly and constituting the bottom or underlying component of vertical face plate 53 whose function is to contact the back or side of load L. Face plate 53 is in open frame form, including laterally opposed vertical, outside risers 54, inside risers 55, a top transverse bar 56, middle transverse bar 58, and bottom bar 57, thereby forming a rigid open framework. In order to project the face plate 53 and its C-shaped housing 52 mounted to the bottom edge thereof, to the forward edge of the underlying rigid support surface members 26, and in position to permit the forklift truck 10 to pick up load L, suitable means is provided for extending and retracting the vertical face plate and the components carried thereby relative to narrow frame 51 of push-pull mechanism 50. As illustrated, one or more hydraulic motors 44 are fixedly mounted to narrow vertical frame 51. Motor 44 includes a cylinder 46. Cylinder 46 carries internally a piston (not shown). A piston rod 48 coupled thereto projects outwardly of the end of the cylinder 46 and is pivotably connected to arm 34 via pin 49, such that the piston rod 48 drives the face plate 53 forwardly as the piston rod extends from the cylinder 46, towards the front of the underlying platen members 26 such that arms 34 and 36 move towards axial alignment. Of course, the cylinder and rod mechanism, i.e., hydraulic motor 44, is exemplary of only one mechanism capable of achieving the desired results, and another drive motor may be appropriately employed in lieu thereof.

Face plate 53 mounts, depending from transverse bar 58, one or more hydraulic cylinders at 60 whose axes are vertical. Piston rods 62, FIG. 1, carried by hydraulic cylinders 60 mounts at their lower ends a single mechanical clamping bar 64 having a recess 65 within its lower end to form projecting portions 64*a* at each side. In the illustrated embodiment of FIG. 1, two such hydraulic cylinders are shown, which function to drive laterally spaced projecting portions 64*a* against lip 13 to physically clamp lip 13 of the air bearing slip sheet 12 against the bottom wall 59 of the C-shaped housing 52. A top wall 61 of housing 52 includes a slot or slots 63 therein permitting projection and retraction of clamping bar 64, as indicated by the double headed arrow, FIG. 1*a*, towards and away from the bottom wall 53 of that housing 52.

In addition, as seen in FIG. 1*a*, the open frame face plate 53 fixedly supports an air unit, indicated generally at 66, which in accordance with prior U.S. Pat. No. 3,948,344 may be a small air compressor driven by the engine of the forklift truck or electric motor providing the necessary traction to the forklift truck itself. Alternatively the air unit 66 may be a battery powered blower similar to a vacuum cleaner blower and constituting a source of low pressure, low CFM air suitable for providing the type of air bearing achieved in the air pallet of prior U.S. Pat. No. 3,948,344.

Purposely, FIG. 1 does not show the complete extent of the means for supplying low pressure air to the plenum chamber of the slip sheet 12, while FIG. 1*a* purposely details the clamping bar means and the means for supplying air to the plenum chamber of the slip sheets without complicating the drawing by the incorporation of the pantagraph mechanism 32. In FIG. 1*a*, it is noted that two separate bars 64 are employed, each hydraulically driven by way of separate hydraulic cylinders 60 and disposed to opposite sides of the forklift truck. FIG. 1*a* therefore shows a slight variation in contrast to FIG. 1 in which a single clamping bar 64 is recessed so as to limit the area of clamping of the slip sheet lip 13. Effectively, the single bar in FIG. 1 at 64 operates the same as the dual bars 64 in FIG. 1*a*. Additionally, it should be noted that in FIGS. 2 and 3, while hose end 72 and clamping bar 64 are illustrated, by breaking away the ends of face plate 53, these figures are uncomplicated by the details of those mechanisms which may be gleaned from FIGS. 1 and 1*a*.

In conjunction with the invention, the air unit 66 supplies low pressure, low CFM air through hose 68 to one or more hose outlets, as for instance, outlet 74 central of face plate 53. In FIG. 1*a*, divider hoses 70 connected at one end to hose 68 terminate at laterally spaced air outlets 72 at the distal ends of hoses 70 at respective sides of the forklift truck push-pull mechanism.

Figure 4:
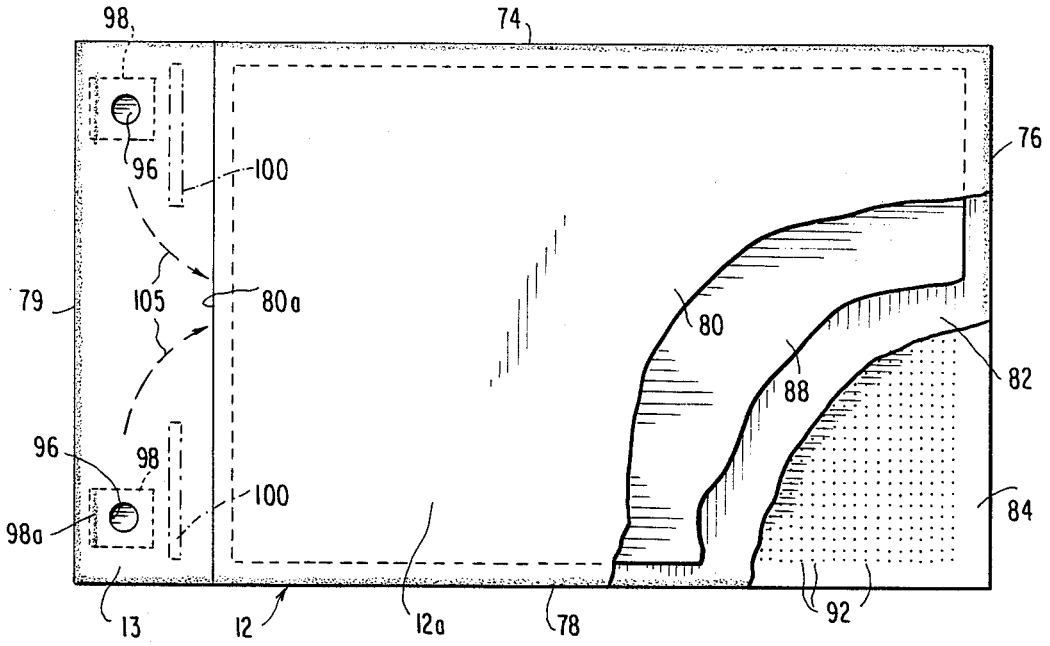
FIG. 4 is a top plan view of the integrated air bearing slip sheet forming a principal component of the present invention of the material handling system illustrated in FIG. 1.
Figure 5:
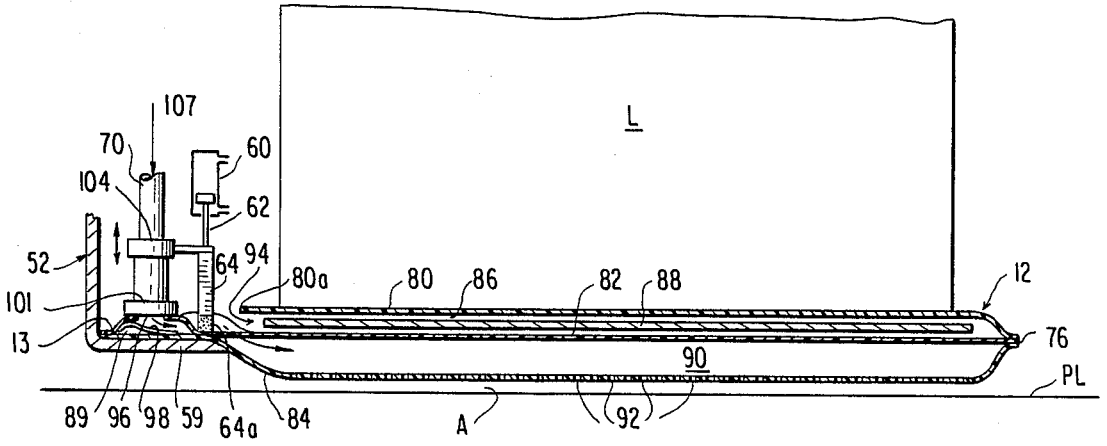
FIG. 5 is a sectional view of the air bearing slip sheet of FIG. 4 taken about line 5—5.

As may be seen best by reference to FIG. 5, low pressure, low CFM air is supplied to the integrated air bearing slip sheet such as slip sheet 12, simultaneously with the mechanical clamping of the slip sheet lip 13 and under conditions in which the mechanical clamping does not interfere and to some degree enhances the air pressurization of the plenum chamber of the air bearing slip sheet 12 by facilitating air distribution to the slip sheet plenum chamber. That action is achieved by using specially formed air bearing slip sheet 12, FIGS. 4 and 5.

The air bearing slip sheet 12 is specially designed to accommodate a unitized load such as load L, FIG. 1, and is of a standardized size such as 48×60 inches for the load bearing section indicated at 12*a* and laterally of projecting lip 13 integrated thereto. Normal slip sheet lips are from roughly three inches to six inches, the same being true for lip 13. The lip must be strong enough that via brute force, the push-pull unit can grab the lip, pull the lip forward (with the load) or push the lip with the load thereon away from the chassis of the forklift truck 10. As may be appreciated, by creation of an air bearing A beneath the air bearing slip sheet, the force required is perhaps one hundredth of that needed to pull or push the lip, absent the air bearing, in overcoming the frictional resistance to pulling or pushing the conventional loaded slip sheet.

Lip 13 is required to have adequate air inlet means some place within the lip. The lip must have available contact areas for clamping bar or bars 64 to securely lock the slip sheet to the bottom wall 59 of gripper jaw pocket housing 52 above wedge shaped support surface members 26, and the lip 13 must have suitable free flexible sheet surface portions with enough flexibility to balloon or expand to effect air travel through the chamber within the lip into the plenum chamber underlying the load L and opening to the perforated portion of the slip sheet bottom layer. As such, there must be sufficient room within the lip to expand in order to initiate jacking of the load at one edge of the load and then move throughout the plenum chamber under the load. The lip chamber is required to have air dispersion means therein or performed by components thereof or acting on the air bearing slip sheet to fulfill the requirements as set forth in U.S. Pat. No. 3,948,344.

In similar fashion to U.S. Pat. No. 3,948,344, the components of the air bearing slip sheet 12 are formed principally of thin, flexible sheet material. Preferably, three sheets are employed. A top sheet 80, an intermediate sheet 82, and a bottom sheet 84, FIGS. 4 and 5. The top and intermediate sheets are imperforate. The intermediate and bottom sheets are sealed together at their edges, i.e. about all four sides, as at 74, 76, 78 and 79. Top sheet 80 is heat sealed to the intermediate sheet and the bottom sheet about three sides 74, 76 and 78, but edge 80*a* is unsealed to form an opening 94 leading to the interior thereof and forming a pocket as at 86, within which is positioned a semi-rigid sheet 88 formed of plastic or like constituting a generally rigid backing member for the air bearing slip sheet 12. Alternatively, the load may form the backing member. It should be noted that pocket 86 and top sheet 80 extend only over the load area defined by load L, FIG. 5. Beyond the open edge 80*a* of the top sheet lies slip sheet lip 13, defined solely by the intermediate sheet 82 and the bottom sheet 84. Within the intermediate sheet 82, at lip 13 in the illustrated embodiment, are provided laterally opposed holes or air inlet openings 96 of circular configuration and opening directly to lip chamber 89, that is, the space between intermediate sheet 82 and the bottom sheet 84 within lip 13. Further, a pair of flexible strip valves 98 are provided within the lip chamber 89 of rectangular form, sized excess to the diameter of the holes 96, underlying the holes 96 and being sealed or otherwise fixed along one edge 98*a* to the bottom surface of intermediate sheet 82, adjacent the hole 96. The function of the flap valves 98 are to close off the openings, and to selectively permit air to enter one of the inlet holes 96, while the other is closed off upon air pressurization of lip chamber 89.

In the manner of U.S. Pat. No. 3,948,344, the bottom thin flexible sheet 84 bears thousands of minute pinhole perforations 92 in a rectangular pattern form, FIG. 4, corresponding to by the imprint of load L, through which low pressure air within plenum chamber 90 formed by intermediate sheet 82 and bottom sheet 84, escape to create air bearing A of several mils thickness, all in the manner of U.S. Pat. No. 3,948,344. The presence of semi-rigid sheet 88 as a backing member permits the load L to be distributed over the complete area of perforations 92 within the bottom thin flexible sheet 84, to facilitate the jacking of the load upwardly and the maintenance of the air bearing A.

To achieve this, in the illustrated embodiment, FIG. 5, automatically as clamping bar portions 64*a* are pressed downwardly against the top of the intermediate thin flexible sheet 82 at areas 100, FIG. 4, between holes 96 and pocket 86, by operation of hydraulic cylinders 60 and extension of piston rods 62, the ends of air supply hoses 70 are pressed into contact with sheet 82 about holes 96. Particularly, collars 101 of hose ends 72 are pressed against the exterior of the intermediate thin flexible sheet 82 about the periphery of the air inlet hole 96. The rush of low pressure air through the hose 70 penetrates the space between the intermediate sheet 82 and the bottom sheet 84 at lip 13. As illustrated in FIG. 5, a collar or clamp 104 attached to each hose 70 is physically coupled to the clamping bar 64 so as to be movable therewith, forcing the end of each hose 70 to follow that movement, as indicated by the double headed arrow 102, FIG. 5. Low pressure air from air unit 66, as indicated schematically in FIG. 5 by arrow 107, flows through air inlet hole 96 deflecting the flap valve 98 away from that hole, to permit air to enter lip chamber 89. The air is free to travel within the lip chamber 89, except those areas closed off by clamping bar projecting portions 64*a*, i.e. areas 100, FIG. 4 Assuming that air flows into both air inlet holes 96, air flow will tend to move between the clamping bar areas 100 and into the plenum chamber 90, as directed by the dotted arrows 105, FIG. 4, at the same time separating the intermediate sheet 82 from the bottom sheet 84 in the area of lip 13. The sheet 82 being flexible moves upwardly to seal with collars 101 for both hoses 70 relative to holes 96 to opposite sides of the air bearing slip sheet 12. By having an expansion or ballooning of the lip 13 starting narrowly near the lateral edges of the slip sheet lip chamber 89 and expanding to a wider dimension and inwardly towards the load L, the lip 13 provides both initial air dispersion and initial jacking for the load L from the lip end of the air bearing slip sheet 12 towards the opposite end thereof. Further, preferably, the semi-rigid sheet 88, while being of a length generally equal to the full length of pocket 86, is of lateral width less than the width of plenum chamber 90 so that automatically continued air distribution occurs within the plenum chamber down both sides thereof and within all areas of the plenum chamber effectively outside of the backing member 88 and the imprint of the load L.

As may be appreciated, the air bearing slip sheet can have more than one lip and more than one air entry to a given lip. All that is necessary is either to effect simultaneous air flow through all of the air inlets or insure that the air inlets have self-closing flap valves or other means to close the non-active air inlets. In that respect, the flap valves may differ from those shown in FIG. 4, as for instance, in accordance with the teachings of U.S. Pat. No. 3,948,344.

Further, while the backing member has been described as a semi-rigid sheet such as plastic, the backing member may comprise cardboard, plywood. Its function is to provide a rigid backing surface for the load and to the plenum chamber 90 so as to cooperate with the underlying support surface which in this case is constituted by a platform PL, FIG. 2, at the time of initial creation of the air bearing and which, in operation of the forklift truck 10, transfers to the rigid, tapered platens 26 overlying forks 28.

Additionally, the semi-rigid sheet 88 functioning as a backing member, assists in preventing ballooning of the thin flexible sheet 84 forming the bottom member of the air bearing slip sheet 112. The flexible sheet 84, when pressurized with air, seeks a round, i.e. circular shape. By restricting that shape, by utilizing a rigid piece of material, there is developed a planar plenum chamber 90 which follows the planar surface of the floor or platform (as well as the rigid platens 26) upon which the slip sheet is moved once the air bearing A is created between that member and the platform PL, FIGS. 1 and 5.

As may be appreciated, additional means may be employed for insuring air dispersion throughout the chamber. It should also be appreciated that the initial pillowing of the air bearing slip sheet 12 at lip 13 continues to the plenum chamber and causes aggressive upward jacking of the load L from the lip end towards the opposite end of the slip sheet 12. By limiting the perforated area at the end adjacent edge 76 of the slip sheet, there will be a pillowing at that end tending to balance out the one occurring in the area of the lip 13. This overcomes the tendency to tilt the load backwards, thus balancing out the load L in relation to the amount of rise at the front and back of the slip sheet. For instance, if the lip is four to six inches, there will be several inches of rise initially when the lip pillows, thus by shortening perforated area at the rear, insurance that the front and rear lift balances the load during lift and facilitates pillowing without ballooning of the air bearing portion of slip sheet 12.

While the thin flexible sheets 80, 82 and 84 may comprise polyvinyl chloride, different types of film material may be employed. The sheets may be formed of polyethylene. Additionally, TYVECK may constitute one or more of the thin flexible sheets, particularly the bottom flexible sheet 84 bearing the perforations and to which most of the wear occurs during use. Of course, in terms of the size of the hydraulic cylinder or motor 46 for driving the push-pull apparatus 50, the hydraulic motor can be significantly reduced in size and capacity since the drag load, once the air bearing A is effected may be as much as 100 times less than that absent the air bearing, i.e. the force required to push or pull the load onto and remove the same from the support surface members 26. The surface of the flat platens 26 underneath the slip sheet 12 is required to cover at least 60% to 66% of the exposed, perforated area of the slip sheet to provide an adequate air bearing surface to permit the load to be frictionlessly moved on and off the forklift truck 10 or like vehicle. Further, the angle of inclination of the wedge-shaped platens 26 must be less than the pillowing that is permitted in the slip sheet to travel over the fulcrum point.

Advantageously, the clamp or clamps employed in the push-pull mechanism 50 of the modified forklift truck 10 is significantly lighter since the reaction force to pulling or pushing is considerably less. For comparison purposes, to move a 2,000 pound load, ordinarily the hydraulic cylinder 44 would have to supply at least 2,000 pounds pressure to move a 2,000 pound mass of material, i.e. load L. With air bearing A underneath the load created by low pressure air exiting from the thousands of minute perforations 92, at low CFM, only 20 pounds pressure, i.e. a ratio of about one pound of air for every 100 pounds of mass is required.

It should be appreciated that the area where load is applied to the lip 13 of the air bearing slip sheet 12 is very important. In addition, the clamping areas are critical. Effective, uniform gripping all the way across the unit is necessary. However, an effective grip at a singular location such that a single area 100 at the center of the lip 13 would suffice. Further, an air inlet at the center or singly to one side may be effected. However, by employing dual air inlets as at 96 at opposite corners of the air bearing slip sheet lip 13, this permits air to be applied to the inlet at the corner providing the best access. When the loads are stacked within a confined building, tractor trailer or box car adjacent one sidewall or at a corner location, access for providing air to the plenum chamber and jacking of the load may be limited, requiring access at one corner or the other, depending upon which side of the tractor trailer or box car the load is being picked up from or deposited by the forklift truck 10 or its equivalent.

It should be kept in mind that identical to U.S. Pat. No. 3,948,344, the perforations 92 unrestrictedly open to the interior of the plenum chamber 90 as well as to the exterior of the slip sheet, and the air after jacking of the load L some of the perforations 92 around the periphery of the perforation pattern P to move away from the underlying support surface, i.e. platform P1, FIG. 5, exposing the perforations freely, resulting in a significant amount of the air from the plenum chamber escaping through those perforations. An equilibrium position is reached where the load L is jacked to its maximum extent, and the air bearing A is maintained, permitting the load L to be moved on a relatively frictionless air bearing A between the bottom of perforated sheet 84 and the load support surface defined by platform PL. At the same time, this equilibrium position insures that ballooning of the thin flexible sheets forming the plenum chamber will not occur along with the effect of the generally rigid backing member, in this case formed by inserted semi-rigid sheet 88. Further, it should be appreciated that air dispersion means internally of the plenum chamber is not desirable, as in accordance with U.S. Pat. No. 3,948,344, for slip sheets, since slip sheets travel with the load. If the load is travelling within a tractor trailer or within a railroad box car, the vibrations tend to cause a wear area on the bottom sheet forming the plenum chamber, wherever that bottom sheet contacts internal strips or other internal air dispersion members. It also provides an area for catching and tearing of the thin flexible sheet or sheets when the forks or paired or singular wedge-shaped generally rigid platens 26 are employed, and moved relatively under the air bearing slip sheet 12 in moving the load onto the forklift truck after creation of the air bearing A. Thus, it is necessary to maintain air dispersion, outside of the load area of the air bearing slip sheet. Air dispersion is also effected by providing a semi-rigid backing member 88 of a width less than the width of the plenum chamber 90, and that member itself functions adequately to insure air distribution down and along the sides of the plenum chamber prior to jacking of the load to insure jacking, load balancing front to rear and thence the creation of the air bearing itself. The load alignment component or face plate 53 at the clamping members 6 is a necessity since that vertical guide aligns the clamping members 64 with the load and on the lip 13 of the slip sheet 12. Since the presence of the air bearing A insures the need for horizontal moving forces which are extremely minimal in relation to the weight of the load, a clamping bar or bars 64 could be as short as four inches in width, as per FIG. 1*a*, thereby insuring the major lateral surface area of the lip 13 is free, materially improving air distribution through lip chamber 89 leading to plenum chamber 90.

Referring next to FIGS. 7*a*–7*e*, there are illustrated in perspective view, the lip portions, indicated at 13*a*–13*e*, respectively, of a number of air bearing slip sheets 12, each showing one or more clamping areas at 100, air inlets a 96, and in dotted lines the air distribution path or paths as at DP. The air inlets 96 are shown in oval form or as modified oval form in some cases indicative of a different configuration for the air inlet and permitting direct insertion of a wand such as that illustrated in U.S. Pat. No. 3,948,344. A relatively large variation in placement of the clamping bar or bars 64 and air inlet holes 96 permit both effective traction force application to the air pallet 12 and load L borne by the same, while effectively supplying and distributing air through the lip chamber to the plenum chamber of the respective air bearing slip sheets of which the various lips 13*a*–13*e* form components thereof.

In FIG. 7*a*, there is a single air inlet hole 96 at the lateral center of the lip 13*a* with a single clamp area 100 behind the same. Air distribution D. P. occurs to the right and left of the single air hole 96 and about both sides of the clamping area 100.

In FIGS. 7*b*, the air hole 96 is still at the center but a pair of clamping areas 100 are provided adjacent the lateral edges of the slip sheet lip 13*b*. Air distribution D. P is through the center of the lip directly to the plenum chamber and between the clamping areas 100.

In FIG. 7*c*, a single central clamping area 100 is shown in between air inlets 96 opening at the lateral edges of the slip sheet lip 13*c*, and the air distribution paths indicated at DP terminate, respectively, at the sides of the clamping area 100.

In FIG. 7*d*, air inlet holes 96 are at the lateral sides of the lip 13*d*, and similarly the clamping areas 100 are to the same sides and longitudinally in line with the air inlet holes 96. The air sweeps across and from respective air inlet holes 96 operated jointly or selectively, moving into the plenum chamber through the open center of the air bearing slip sheet lip 13*d*.

FIG. 7*e* shows an arrangement wherein a pair of clamping areas 100 to respective sides of the lip 13*e* form an air distribution path, as indicated by the dotted lines D. P., again passing between the two clamping areas 100, but emanating from a single side entry air inlet hole 96.

Referring to FIG. 6, the forklift truck 10 is shown under conditions where it is employed as a conventional forklift with the push-pull mechanism 50 completely retracted and with push-pull mechanism face plate 53 backed to the elevator mechanism 32, thereby permitting the platens as generally rigid support members 26 to be pivoted to upright position against the load alignment open frame face plate 53 and exposing the rigid underlying forks 28. The forklift truck 10 then may be operated in a conventional sense and the elevator mechanism 31 will, of course, lift the forks 28 vertically upward along with the push-pull mechanism 50. The forks are capable of supporting a conventional wooden pallet and a unitized load such as load L of FIG. 1.

It should be kept in mind that the components mounted to and forming part of the forklift truck 10, particularly applicable to the creation of the air bearing beneath the slip sheet 12 and for effecting push-pull movement of load L on the air bearing slip sheet 12, may be adapted to a simple hand pallet truck in which case the hand pallet truck may be devoid of hydraulics and in which operation of movement of the clamping bars 64, FIG. 1*a*, may be effected by a simple, manually operated, mechanical mechanism such as by screwing the bars up and down, or by utilizing of eccentrics or cams to shift the bars, which may be spring biased normally into retracted position. Further, the air unit may constitute a battery powered unit mounted to the rear of the hand pallet truck via the load, but functioning in the manner of the system of the unit 66 shown in FIG. 1.

From the above, it is apparent that certain structural requirements must be met in terms of the creation of a suitable air bearing slip sheet as well as the constituent content of the forklift truck or hand pallet truck operatively employed in moving the palletized load on the air bearing slip sheet. With respect to the truck, an upright vertical face plate 53 must be aligned to a side of the palletized load L functioning as a rigid wall for laterally supporting the load L on the side next to the prime mover and providing alignment of an air source borne by the vehicle to an inlet valve within the slip sheet lip. A solid bottom plate or platen, unitary or split, is required to support the slip sheet and the unitized load. The surface area of the platen must be large enough to support approximately two-thirds of the load's bottom surface. The platen bottom plate or paired plates must angle downward to meet the supporting floor surface, i.e. the platform upon which the load rests prior to movement and which provides an inclined plane for the air moving system (air bearing slip sheet with load) to ride on. The vehicle must include one or more clamping devices 64 closing onto and pressing the lip of the air bearing slip sheet to clamp the slip sheet outside of the load area during movement onto and from the platen plate or plates of the forklift truck or its equivalent. The clamp bar or bars 64 must be such as not to interfere with the delivery of air into the chamber within the lip portion of the slip sheet which extends from under the load. Further, the air must flow freely into the air inlet, achieve pillowing of the flexible sheet members defining the extended area expansible chamber of the slip sheet leading to the plenum chamber and effect jacking of the load, pillowing of the plenum chamber proper under the load and full air dispersion throughout the plenum chamber beneath the load, prior to air escape through the perforations of the bottom thin flexible sheet to effect the creation and maintenance of the air bearing of several mils thickness between the bottom sheet and the underlying support surface.

The clamping system may comprising a single vertical displaceable clamping bar or several bars, strategically positioned to allow air flow into the jacking area for the load and for dispersal through the plenum chamber to create the frictionless air bearing. The clamping system involves vertically reciprocating clamping bars clamping onto the bottom of a gripper air pocket C-shaped housing after insertion of the air bearing slip sheet lip therein, whether the lip is coplanar with the portion of the slip sheet bearing the load or tilted upwardly from the horizontal plane. Manually operable mechanisms for raising or lowering the clamp bars utilizing cams, screws, wedges or the like, or pneumatic or hydraulic linear motors (significantly smaller than devices normally employed for clamping conventional slip sheet lips) may be used, since the load will move laterally with relative ease due to the existence of the air bearing.

Preferably, the air source is attached to the vertical upright structure of the elevator system or the push-pull mechanism movable outwardly of the forklift chassis and vertically with the fork. The air source hose component for supplying air to one or more inlet valves within the slip sheet lip must be mounted in a manner so as to be in alignment with the inlet valve or valves and preferably for automatic coupling of the hose to each slip sheet inlet valve for pressurization of the chamber within the slip sheet lip leading directly to the plenum chamber forming the air bearing itself. Alternatively, attachment and detachment of the air source to the slip sheet air inlet or inlets may be effected manually.

The air supply unit under certain circumstances may be borne by or supported by the load itself with hose attachment to the slip sheet inlet valve being manually effected.

Preferably, the platen, whether split or unitary, is hinged at its rear so that it may be raised to horizontal position and fully exposed paired forks compatible with normal wooden pallet handling.

While the invention has been particularly shown and described with reference to preferred embodiments thereof, it will be understood by those skilled in the art that the foregoing and other changes in form and details may be made therein without departing from the spirit and scope of the invention.

What is claimed is:

1. An air bearing slip sheet type material handling system for handling a load, said system comprising:

a wheeled vehicle having a vehicle chassis, platen means extending generally horizontally from the vehicle chassis at the bottom thereof in a forward direction and terminating in a forward edge for contact with an underlying support surface bearing said wheeled vehicle.

a push-pull mechanism mounted to said vehicle chassis and including a vertical narrow frame a pantagraph mechanism mounted to said vertical narrow frame at one end and mounting a vertical face plate at the end remote from said chassis having a gripper jaw pocket housing at the bottom thereof defining a horizontal slot running the width of said narrow frame for overlying the tip of said platen means, said system further comprising an air bearing ship sheet, said air bearing slip sheet comprising top and bottom thin flexible sheets sealed together about the edges thereof to define a plenum chamber therebetween, and forming a load support portion over a major surface area thereof, and at least one integral lip along an edge thereof projecting outside of the load area, one of said slip sheet and said load comprising a generally planar rigid backing member within the load area, a plurality of pinhole perforations within a central portion of the bottom thin flexible sheet over an area conforming to the footprint of the load carried by said slip sheet on said generally planar rigid backing member, said lip being positionable within said gripper jaw pocket when projecting laterally exterior of the load, air inlet means within the tip thin flexible sheet at said lip, at least one clamping bar mounted to said face plate above said gripper jaw housing for clamping said lip against the bottom of said gripper jaw housing such that retraction of the pantagraph mechanism with said lip clamped to said bottom of said gripper jaw pocket housing causes the slip sheet and the load to move onto the platen while extension of the pantagraph mechanism pushes the slip sheet and the load off the platen and away from the chassis, a low pressure air source carried by one of said vehicle and said load, a hose coupled to said air source and terminating in an air outlet, means for depressing and retracting said clamping bar into and out of said gripper jaw pocket, and means for operatively positioning said hose air outlet relative to said air inlet means for alignment with an air inlet opening of said slip sheet lip; and means responsive to operation of said air source, and depression of said clamping bar for connecting said air outlet to said air inlet opening for directing compressed air into an air chamber interior of said slip sheet lip, for flow about the clamping area, and from an air chamber of said lip to the plenum chamber for jacking of the load, and for the creation of an air bearing, whereby, the presence of the air bearing beneath the slip sheet underlying said load, permits relatively frictionless movement of said slip sheet and the load carried thereby onto and from the platen of said wheeled vehicle

2. The material handling system as claimed in claim 1, wherein the end of the hose forming the air outlet is mechanically coupled to the clamping bar and moveable therewith for connection of the air supply hose air outlet to the slip sheet air inlet opening of the lip to cause air flow to penetrate the lip chamber to effect pressurization of the lip chamber and plenum chamber of the air bearing slip sheet upon clamping of said slip sheet lip by said clamping bar

3. The material handling system as claimed in claim 2, wherein the air bearing slip sheet is oriented relative to the gripper jaw pocket and the clamping bar carried thereby, such that the clamping bar engages the lip proximate to the load and the plenum chamber to the side of the load borne by the slip sheet to the load side of the air inlet opening within said lip and wherein initially flow of compressed air through the lip air inlet opening causes the top thin flexible sheet to move away from the bottom thin flexible sheet at said lip to effect pillowing thereof, and wherein compressed low pressure air flows through the lip chamber formed thereby about the clamping area formed by the clamping bar into the plenum chamber for causing the load to be jacked from the lip end of the air bearing slip sheet towards the opposite end thereof in a progressive manner and subsequent creation of the air bearing by low CFM flow of low pressure air through the plurality of pinhole perforations within the thin bottom sheet underlying the load.

4. The material handling system as claimed in claim 3, wherein said bottom thin flexible sheet includes an area along the end opposite that forming the lip, which is devoid of perforations, and wherein said air bearing slip sheet further includes air dispersion means for insuring rapid flow of low pressure air from the lip chamber to the area of the plenum chamber wherein said bottom sheet is devoid of perforations at the end for causing pillowing of that end of the slip sheet to a degree comparable to that of the slip sheet lip so as to balance the load during jacking of the load and creation of the air bearing.

5. The material handling system as claimed in claim 4, wherein said generally rigid backing member comprises a generally rigid sheet, said air bearing slip sheet comprises a third thin flexible sheet overlying said top thin flexible sheet and being sealed about the two sides thereof and the end remote from said lip to said at least the top thin flexible sheet and forming a rigid backing member receiving pocket therebetween, said third sheet overlying said tip thin flexible sheet over the full extent of said load bearing area of said slip sheet, and terminating at said lip in a free edge forming an opening to said pocket for slidable insertion and removal of said generally rigid planar backing member.

6. The material handling system as claimed in claim 5, wherein said vehicle comprises a forklift truck, said chassis includes a bottom plate having a pair of forks fixedly projecting therefrom outwardly of said vehicle chassis and underlying the platen, and wherein said platen is pivoted at its end proximate to the vehicle chassis for movement between a generally horizontal position in contact with and overlying the fixed forks to a vertically upright position adjacent the face plate when in a retracted position.

7. The material handling system as claimed in claim 2, wherein the end of said hose carries a collar sized in excess of the diameter of the air inlet means, and wherein when the connection of the air supply hose to the slip sheet air inlet opening at the lip occurs, the rush of low pressure air into the lip chamber causes the top thin flexible sheet about the air inlet means to move against the collar, thereby sealing the connection between the lip chamber and the interior of the hose at the hose end air outlet.

8. In a forklift truck constituting a wheeled vehicle having a vehicle chassis, platen means extending generally horizontally from the vehicle chassis at the bottom thereof and terminating in a forward edge for contact with an underlying support surface bearing said wheeled vehicle, a push-pull mechanism mounted to said vehicle chassis and including a vertical narrow frame a pantagraph mechanism mounted to the narrow vertical frame at one end and mounting a vertical face plate at the end remote from said chassis, having a C-shaped gripper face plate jaw pocket housing at the bottom thereof forming a slot running the width of the narrow frame, overlying the tip of the platen means, said forklift truck being employed with an air bearing slip sheet said air bearing slip sheet comprising tip and bottom thin flexible sheets sealed together about the edges thereof to define a plenum chamber therebetween and forming a load support portion over a major surface area thereof and having at least one integral lip along an edge thereof projecting outside of the load area, one of said slip sheet and said load comprising a generally planar rigid backing member within the load area, a plurality of pinhole perforations within a central portion of the bottom thin flexible sheet over an area conforming to the footprint of the load carried by the slip sheet on said rigid backing member, said lip being positionable within the gripper jaw pocket housing when projecting laterally exterior of the load air inlet within means tho top thin flexible sheet, at said lip, and said push-pull mechanism further comprising at least one clamping bar mounted to the face plate above said gripper jaw casing for clamping said lip against the bottom of said gripper jaw pocket casing such that retraction of said pantagraph mechanism with the lip clamped to the bottom of said gripper jaw pocket housing causes the slip sheet and the load to move onto the platen, while extension of said pantagraph mechanism pushes the slip sheet and the load off the platen and away from the chassis, the improvement comprising:

a low pressure air source carried by one of said vehicle and said load, an air supply hose coupled to said air source and terminating in an air outlet, means for commonly projecting and retracting said clamping bar relative to the bottom wall of said gripper jaw pocket housing and for operatively coupling the hose air outlet to the air inlet means within said air bearing slip sheet lip, such that operation of the air source upon projection of said clamping bar directs compressed air into the air chamber interior of said slip sheet lip for flow about the clamping area and from the air chamber within said lip to the plenum chamber for progressive jacking of the load and creation of an air bearing between the bottom thin flexible sheet and the underlying support surface;

whereby, the presence of the air bearing beneath said slip sheet underneath the load permits relatively frictionless movement of said slip sheet and load carried thereby onto and from the platen of said forklift truck

9. The forklift truck as claimed in claim 8, wherein the end of the hose forming said air inlet is mechanically coupled to said clamping bar and movable therewith, and the air outlet of said hose is axially aligned with said air inlet means.

10. An air bearing slip sheet for use in a material handling system utilizing a wheeled vehicle having a vehicle chassis, platen means extending generally horizontally from said vehicle chassis at the bottom thereof to the front thereof and terminating in a forward edge for contact with an underlying support surface bearing said wheeled vehicle a push-pull mechanism mounted to said vehicle chassis and including a vertical narrow frame, a pantagraph mounted to said narrow vertical frame at one end and mounting a vertical face plate at the end remote from said chassis, said face plate having a C-shaped gripper jaw pocket casing at the bottom thereof facing away from said chassis and defining a horizontal slot running the width of the narrow frame, capable of overlying the tip of said platen means, at leas one clamping bar mounted to said face plate at said gripper jaw casing for movement into contact with the bottom wall of said gripper jaw casing, a low pressure air source carried by said vehicle, an air supply hose coupled to said air source and terminating in an air outlet, said air bearing slip sheet comprising top and bottom thin flexible sheets sealed together about the edges thereof to define a plenum chamber therebetween and forming a load support portion over a major surface area thereof, at least one integral lip along an edge thereof projecting outside of the load area, one said slip sheet and said load comprising a generally planar rigid backing member within the load area, a plurality of pinhole perforations within a central portion of said bottom thin flexible sheet over an area conforming to the footprint of the load carried by said slip sheet on said generally planar rigid backing member said lip being positionable within said gripper jaw pocket casing when projecting laterally exterior of the load, air inlet means within the top thin flexible sheet at said lip, outside said load area, said air inlet means being at a position so as to permit coupling to the air outlet of said air supply hose and said air inlet means being located relative to the area of said lip contactable by said at least one clamping bar when projected into clamping position after insertion of said lip within said slot of said gripper jaw casing, such that upon operation of the air source and depression of said clapping bar into clamping position, compressed air exiting said air outlet enter said air inlet means and is directed into the air chamber interior of said slip sheet lip for flow about the clamping area and from the air chamber of said lip to the plenum chamber of jacking of the load and creation of an air bearing; whereby, the presence of the air bearing beneath the slip sheet underlying the load permits relatively frictionless movement of the slip sheet and the load carried thereby onto and from the platen of said forklift truck.

11. The air bearing slip sheet as claimed in claim 10, wherein said air inlet means comprises a pair of air inlet holes within the top thin flexible sheet at spaced apart positions, and wherein said air bearing slip sheet further comprises flexible sheet flap valves internally of the lip chamber fixed to said top sheet, underlying said holes such that the selective delivery of compressed air to one of said air inlet holes and not the other causes the flap valve of said other hole to close off that air inlet means and preventing escape of compressed air from the lip chamber and facilitating jacking of the load and creation of the air bearing.

12. The air bearing slip sheet as claimed in claim 10, wherein said bottom thin flexible sheet includes an area along one end thereof opposite that forming the lip which is devoid of perforations, and wherein said air bearing slip sheet further includes air dispersion means for insuring rapid flow of low pressure air to the area of the plenum chamber wherein said bottom thin flexible sheet is devoid of perforations at said one end for causing pillowing of that end of the slip sheet to a degree comparable to that of slip sheet lip to facilitate balancing of the load during jacking of the load and creation of the air bearing.

13. The air bearing slip sheet as claimed in claim 12, further comprising a third thin flexible sheet overlying said top thin flexible sheet over a substantial portion thereof and being sealed about two sides thereof and along the end remote from said lip to said at least the top thin flexible sheet and forming a rigid backing member receiving pocket therebetween said third sheet overlying the top thin flexible sheet over the full extent of said load bearing area of said slip sheet and terminating at said lip in a free edge forming an opening to said pocket for slidable insertion and removal of said generally rigid planar backing member.

14. The air bearing slip sheet as claimed in claim 10, further comprising a third thin flexible sheet overlying said top thin flexible sheet over a substantial portion thereof and being sealed about two sides thereof and along the end remote from said lip to said at least the top thin flexible sheet and forming a rigid backing member receiving pocket therebetween, said third sheet overlying the top thin flexible sheet over the full extent of said load bearing area of said slip sheet and terminating at said lip in a free edge forming an opening to said pocket for slidable insertion and removal of said generally rigid planar backing member.

* * * * *